US011584617B2

(12) United States Patent
Saarelainen et al.

(10) Patent No.: US 11,584,617 B2
(45) Date of Patent: Feb. 21, 2023

(54) MOTION FEEDBACK IN AN ELEVATOR

(71) Applicant: KONE Corporation, Helsinki (FI)

(72) Inventors: Antti Saarelainen, Helsinki (FI); Andrej Burakov, Helsinki (FI)

(73) Assignee: KONE CORPORATION, Helsinki (FI)

( * ) Notice: Subject to any disclaimer, the term of this patent is extended or adjusted under 35 U.S.C. 154(b) by 1177 days.

(21) Appl. No.: 16/029,298

(22) Filed: Jul. 6, 2018

(65) Prior Publication Data

US 2018/0312370 A1 Nov. 1, 2018

Related U.S. Application Data

(63) Continuation of application No. PCT/EP2016/082827, filed on Dec. 29, 2016.

(30) Foreign Application Priority Data

Jan. 7, 2016 (EP) ..... 16150464

(51) Int. Cl.
*B66B 1/32* (2006.01)
*B66B 5/02* (2006.01)
(Continued)

(52) U.S. Cl.
CPC ..... *B66B 5/02* (2013.01); *B66B 1/32* (2013.01); *B66B 1/3415* (2013.01); *B66B 5/027* (2013.01);
(Continued)

(58) Field of Classification Search
CPC .... B66B 1/32; B66B 5/18; B66B 5/06; B66B 1/30; B66B 5/04; B66B 5/0037;
(Continued)

(56) References Cited

U.S. PATENT DOCUMENTS 8,316,996 B2 * 11/2012 Hashimoto ..... B66B 1/32 187/288
2006/0137941 A1 * 6/2006 Andrejak ..... B66B 5/027 187/293
2018/0134519 A1 * 5/2018 Kattainen ..... B66B 5/0031

FOREIGN PATENT DOCUMENTS

CN 102714483 A 10/2012
CN 204173696 U 2/2015
(Continued)

OTHER PUBLICATIONS

English translation of the Chinese Office Action and Search Report for Chinese Application No. 201680078323.X, dated Dec. 13, 2019.
(Continued)

*Primary Examiner* — Marlon T Fletcher
(74) *Attorney, Agent, or Firm* — Birch, Stewart, Kolasch & Birch, LLP

(57) ABSTRACT

An elevator drive apparatus is described which includes a drive unit for driving an elevator car, a brake device for braking a motion of the elevator car, a detector for detecting an electrical operation amount of the drive unit, and a controller. The controller is configured to release the brake device, to compare the detected electrical operation amount with a threshold, and to apply the brake device when the detected electrical operation amount exceeds the threshold. In this way, it is ensured that a speed of the elevator car in case of a rescue situation is within a safety limit.

9 Claims, 4 Drawing Sheets

(51) Int. Cl.

| | |
|---|---|
| ***B66B 5/06*** | (2006.01) |
| ***B66B 1/34*** | (2006.01) |
| ***B66B 9/00*** | (2006.01) |
| ***B66B 11/04*** | (2006.01) |

(52) U.S. Cl.
CPC ..... *B66B 5/06* (2013.01); *B66B 9/00* (2013.01); *B66B 11/043* (2013.01)

(58) Field of Classification Search
CPC ..... B66B 1/3492; B66B 5/00; B66B 5/0018; B66B 5/0006; B66B 1/06; B66B 29/00
See application file for complete search history.

(56) References Cited

FOREIGN PATENT DOCUMENTS

| | | | | | |
|---|---|---|---|---|---|
| EP | 3190076 | A1 * | 7/2017 | ..... | B66B 1/32 |
| EP | 3480155 | A1 * | 5/2019 | ..... | B66B 1/32 |
| JP | 6950809 | B1 * | 10/2021 | | |
| WO | WO-2014132222 | A1 * | 9/2014 | ..... | B66B 1/32 |
| WO | WO-2017118590 | A1 * | 7/2017 | ..... | B66B 1/32 |

OTHER PUBLICATIONS

International Search Report for PCT/EP2016/082827 (PCT/ISA/210) dated Apr. 11, 2017.
Written Opinion of the International Searching Authority for PCT/EP2016/082827 (PCT/ISA/237) dated Apr. 11, 2017.

* cited by examiner

MOTION FEEDBACK IN AN ELEVATOR

CROSS REFERENCE TO RELATED APPLICATIONS

This application is a Continuation of PCT International Application No. PCT/EP2016/082827, filed on Dec. 29, 2016, which claims priority under 35 U.S.C. 119(a) to patent application Ser. No. 16/150,464.2, filed in Europe on Jan. 7, 2016, all of which are hereby expressly incorporated by reference into the present application.

FIELD OF THE INVENTION

The present invention relates to an apparatus, a method and a computer program product for providing motion feedback in an elevator.

RELATED BACKGROUND ART

The following description of background art and examples may include insights, discoveries, understandings or disclosures, or associations, together with disclosures not known to the relevant prior art, to at least some examples of embodiments of the present invention but provided by the invention. Some of such contributions of the invention may be specifically pointed out below, whereas other of such contributions of the invention will be apparent from the related context.

Some embodiments of the present invention relate to an emergency situation in an elevator. For example, in a rescue situation when there are people trapped in an elevator car and an elevator machinery of the elevator cannot be used to bring the car to a landing, a machinery brake is released in order to let the elevator car advance to the nearest door zone using the imbalance between the car and counterweight. EN81-20 5.6.6.1 requires that there be means for limiting the speed of the car if the machinery cannot be observed visually.

One would be to cycle/pulse the brake using a default frequency. This, however consumes a lot of energy and might compromise the battery lifetime in case of power outage. For example, the power required in pick state is four times higher than the power needed to keep brakes open.

Moreover, if the car and counterweight are very close to being in balance, the car may not move at all. That is, there might be cases in which the cycle time is so short that elevator car might not even move before brakes will close again. Prolonging the cycle time, however, could result in that the speed of the elevator car increases too much in case of a high unbalance.

Thus, it is an object of the present invention by which a reliably procedure for moving an elevator to a landing in case of an emergency can be carried out.

SUMMARY OF THE INVENTION

According to a first aspect of the present invention an elevator drive apparatus is provided which comprises a drive unit for driving an elevator car, a brake device for braking a motion of the elevator car, a detector for detecting an electrical operation amount of the drive unit, and a controller, wherein the controller is configured to release the brake device, to compare the detected electrical operation amount with a threshold, and to apply the brake device when the detected electrical operation amount exceeds the threshold.

According to a second aspect of the present invention, a method for driving an elevator is provided which comprises releasing a brake device configured to brake a motion of an elevator car, detecting an electrical operation amount of a drive unit configured to drive the elevator car, comparing the detected electrical operation amount with a threshold, and applying the brake device when the detected electrical operation amount exceeds the threshold.

The first and second aspects may be modified as follows:

The drive unit may comprise a rotating electrical machine.

The electrical operation amount may be a current and/or a voltage generated by the rotating electrical machine due to a movement of the elevator car after releasing the brake device.

The drive unit may comprise means for short-circuiting the rotating electrical machine, and the electrical operation amount may be a current generated by the rotating electrical machine due to a movement of the elevator car after releasing the brake device.

According to another aspect, an elevator system is provided which comprises at least one elevator car carrying an elevator cabin, and an elevator drive apparatus according to the first aspects or its modifications.

In addition, according to another aspect of the present invention, there is provided a computer program product for a computer, including software code portions for performing the steps of the above defined methods, when said product is run on the computer. The computer program product may include a computer-readable medium on which said software code portions are stored. Furthermore, the computer program product may be directly loadable into the internal memory of the computer or transmittable via a network by means of at least one of upload, download and push procedures.

According to a still further aspect, an apparatus is provided which comprises a drive unit for driving an elevator car, a brake device for braking a motion of the elevator car, a detector for detecting an electrical operation amount of the drive unit, and means for releasing the brake device, means for comparing the detected electrical operation amount with a threshold, and means for applying the brake device when the detected electrical operation amount exceeds the threshold.

The apparatus according to this aspect may be modified similar as the first aspect described above.

BRIEF DESCRIPTION OF THE DRAWINGS

These and other objects, features, details and advantages will become more fully apparent from the following detailed description of embodiments of the present invention which is to be taken in conjunction with the appended drawings, in which.

DETAILED DESCRIPTION OF EMBODIMENTS

In the following, description will be made to embodiments of the present invention. It is to be understood, however, that the description is given by way of example only, and that the described embodiments are by no means to be understood as limiting the present invention thereto.

In particular, different exemplifying embodiments will be described using, as an example of an elevator system to which the embodiments may be applied, an elevator system as depicted and explained in connection with FIG. 1.

It is to be noted that the following examples and embodiments are to be understood only as illustrative examples. Although the specification may refer to "an", "one", or "some" example(s) or embodiment(s) in several locations, this does not necessarily mean that each such reference is related to the same example(s) or embodiment(s), or that the feature only applies to a single example or embodiment. Single features of different embodiments may also be combined to provide other embodiments. Furthermore, terms like "comprising" and "including" should be understood as not limiting the described embodiments to consist of only those features that have been mentioned; such examples and embodiments may also contain features, structures, units, modules etc. that have not been specifically mentioned.

The general elements and functions of described elevator systems, details of which also depend on the actual type of elevator system, are known to those skilled in the art, so that a detailed description thereof is omitted herein. However, it is to be noted that several additional devices and functions besides those described below in further detail may be employed in an elevator system.

Figure 1:
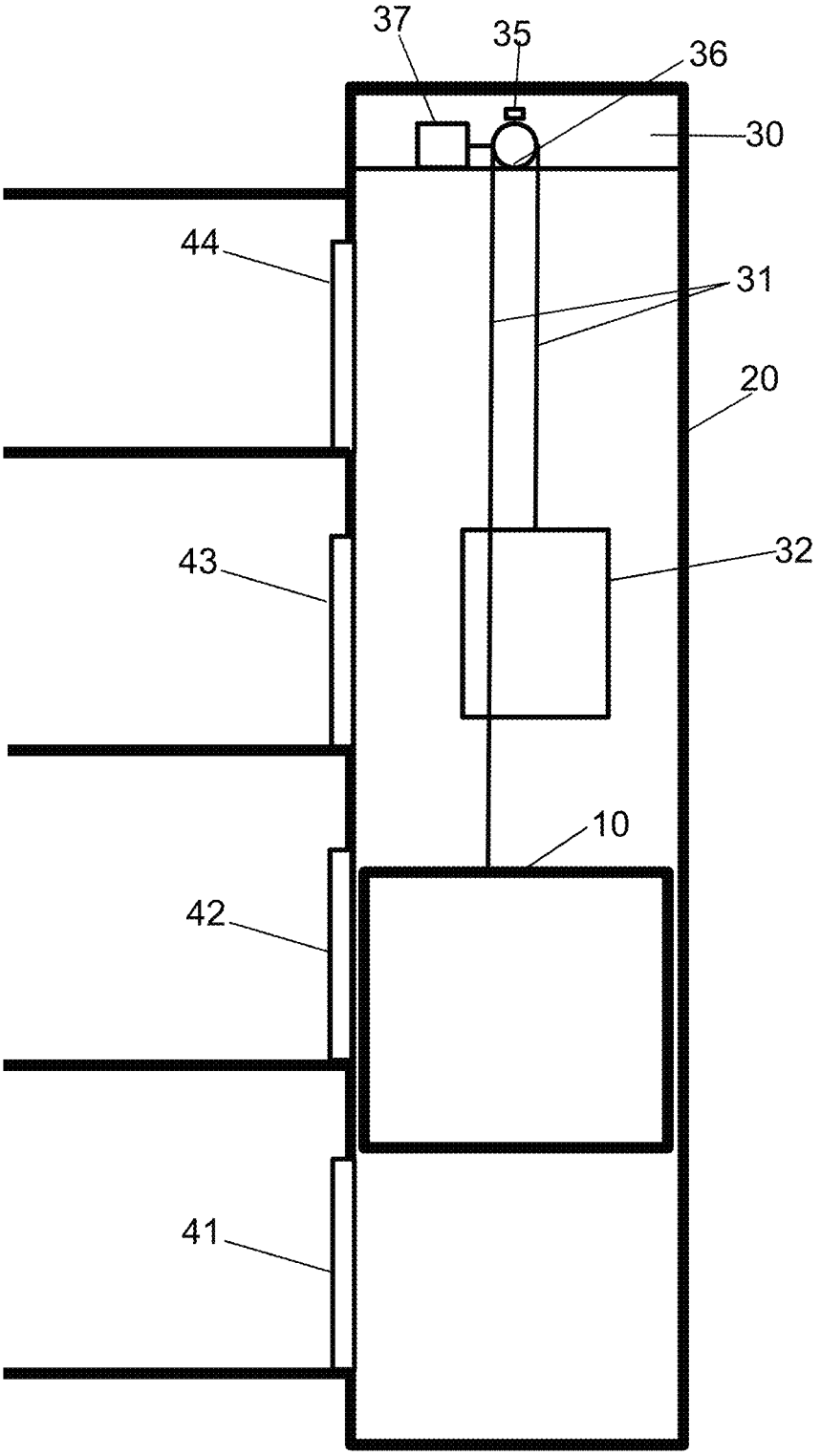
FIG. 1 shows an elevator according to some embodiments of the present invention.

FIG. 1 shows a schematic diagram illustrating a configuration of an elevator system where some examples of embodiments are implementable. It is to be noted that examples of embodiments are not limited to an elevator system structure with the number of levels, elevator cars and lift shafts as shown in FIG. 1. Rather, the number of elements, functions, and structures may be different to that indicated in FIG. 1, i.e. there may be implemented or present more (or less) of the corresponding levels, elevator cars and lift shafts than those shown in FIG. 1.

In FIG. 1, reference sign 10 denotes an elevator car containing an elevator cabin for transporting persons between the floors of a building or the like. The elevator car 10 is located and travels in a hoistway or lift shaft 20 which reaches at least from the lowest floor to the highest floor. A machinery room 30 is provided in a top part of the hoistway 20 and comprises a hoisting machine in form of an electric motor 36, which is driven by an inverter 37. According to the present embodiment, the electric motor is a three-phase synchronous motor, but the motor is not limited to this configuration and can be any kind of suitable electrical rotating machine. The inverter 37 is in this example a frequency converter, but can be any kind of inverter which is able to drive the motor 36. According to some embodiments, the combination of the motor 36 and the inverter 37 is referred to as drive unit.

It is noted that the location of the drive unit (inverter 37 and electric motor 36) is not limited to the location as shown in FIG. 1. In particular, it is not necessary to provide the drive unit in a separate machinery room, rather, it may be located at any suitable place in or at the hoistway 20.

The elevator car 10 is suspended in the hoistway 20 with elevator ropes 31, wherein also a counterweight 32 is suspended with the elevator ropes 31. The elevator ropes are moved by means of the motor 36 via a traction sheave (not shown), which is integrated into the rotor of the motor 36. Alternatively, the traction sheave may be provided separately from the rotor and driven by the motor.

The elevator system further comprises one or more control units which may be provided at different locations, such as in the elevator car 10 or in a control room or the like. The control units are responsible, for example, for operation of the elevator system, such as driving and braking control, power supply control, emergency control, safety procedure control, and the like. Moreover, operation panels in the elevator cabin and at each landing are provided which are coupled to the control units by suitable signaling links.

At each floor or landing, a landing door 41, 42, 43 and 44 is provided for allowing entering or leaving the elevator cabin when the elevator car 10 has stopped at this floor.

In the example illustrated in FIG. 1, it is assumed that an emergency or rescue situation occurred, in which the elevator car 10 has stopped somewhere between the first floor and the second floor. For example, people may be trapped in the elevator car 10, and the elevator machinery (including the electric motor 36) cannot be used to bring a car to a landing. In this situation, the brake device 35 (machinery brake) is released in order to let the elevator car advance to the nearest door zone using the imbalance between the car and counterweight. As mentioned above, EN81-20 5.6.6.1 requires that there be means for limiting the speed of the car if the machinery cannot be observed visually.

Figure 2:
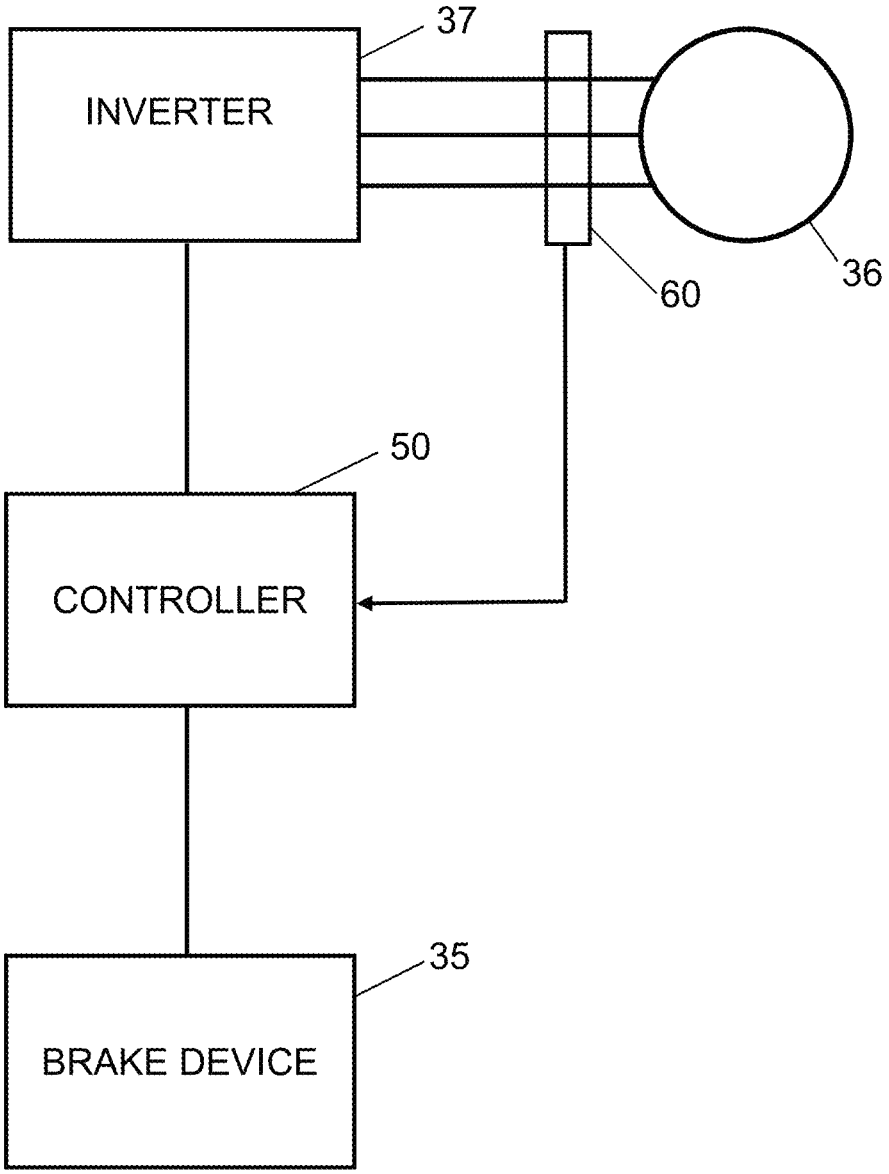
FIG. 2 shows an elevator drive apparatus according to an embodiment of the present invention.

According to a general embodiment of the present invention, this situation can be handled by an elevator apparatus as illustrated in FIG. 2. The elevator apparatus comprises a drive unit (e.g., the electric motor 36 and the inverter 37 including the elevator ropes 31) for driving an elevator car 10, a brake device 35 for braking a movement of the elevator car 10, a detector 60 for detecting an electrical operation amount of the drive unit, and a controller 50. The controller is configured to release the brake device 35, to compare the detected electrical operation amount with a threshold, and to apply the brake device when the detected electrical operation amount exceeds the threshold.

Hence, an output, i.e., the electrical operation amount output from the drive unit is utilized to control the brake device. Namely, when the brake is released, the elevator car 10 will move due, for example, to an unbalance between the elevator car and the counterweight. Due to this movement, also the drive unit (e.g., the electric motor 36) will move, and correspondingly, the detector detects a change in the detected electrical operation amount. When the electrical operation amount exceeds a certain threshold, then the brake device is applied again in order to stop the elevator car.

Figure 3:
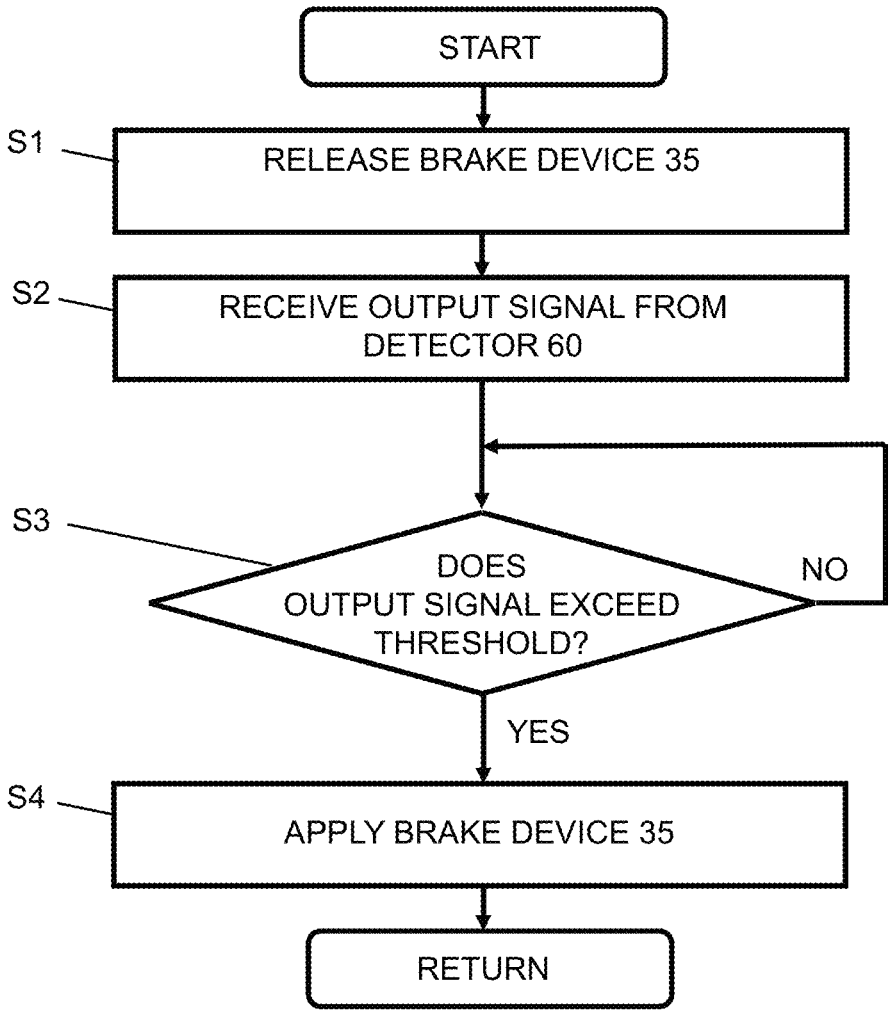
FIG. 3 shows a method according to an embodiment of the present invention.

A corresponding method, which may be carried out by the controller 50, is illustrated in FIG. 3. In step S1, the brake device 35 is released. In step S2, an output signal is received from the detector 60, i.e., the electrical operation amount output from the drive unit. In step S3, the output signal, i.e., the received electrical operation amount, is compared with the threshold. As long as the threshold is not exceeded (NO in step S3), the process of step S3 is repeated, until the threshold is exceeded (YES in step S3). Then, the brake device 35 is applied.

In this way, it can reliably be ensured that the moving speed of the elevator car is limited, even if the machinery cannot be observed visually.

The method as illustrated in FIG. 3 can be repeated until a landing is reached, so that, e.g., trapped people may get out of the elevator car 10.

In the following, some more detailed embodiments of the present invention are described.

According to a certain embodiment of the present invention, a current of the electric motor 36 is used as the electrical operation amount. That is, when the brake is opened in a rescue situation as described above, the current generated by the motor is compared with the threshold.

Thus, the current is used as a motion feedback for an electrical emergency brake opening device (e.g., the brake device 35 as used in an emergency situation). A suitably selected trigger current is used as the threshold, and when the measured current exceeds the trigger value, the brake device is released.

In this case, the detector 60 is configured to detect the current flowing in to or out of the electric motor 36. For example, Hall-Elements may be applied to each line connecting the inverter with a coil of a corresponding phase of the electric motor. Alternatively, a shunt resistor may be included in each line connecting the inverter with a coil of a corresponding phase. However, the configuration of the detector for detecting the current is not limited to these configurations, as long as it is able to detect the current and to supply an output signal indicating the current. Moreover, it is not necessary to provide a current detector member (such as a Hall element or a shunt resistor) in each line. For example, in case of a three-phase motor, it is sufficient to provide only current detectors in two phases, since the third current in the third phase may be calculated based on the detected currents of the two phases.

In addition, it is also possible to provide only one current detector element at one phase of the motor, and to set the threshold correspondingly.

According to a further embodiment, also the current is used as the electrical operation amount to be compared with the threshold, similar as in the embodiment described above. Furthermore, according to this embodiment, the drive unit comprises means for short-circuiting the rotating electrical machine. For example, the inverter 37 may be configured to short-circuit the electric motor 36. Alternatively, a separate switching means may be provided between the inverter 37 and the motor 36 by which the phases are short-circuited.

In this way, a motor short circuit torque is used as an additional safety method. In this case, a voltage generated by the motor 36 cannot be measured, so that according to this embodiment only the current is used as the electrical operational amount (i.e., for providing a motion feedback).

In this way, the current is detected (or measured), and the short circuit torque of the motor will be kept such that the elevator car moves at a safe speed. When the measured current exceeds the threshold (also referred to as trigger value), the brake device 35 is applied.

Figure 4:
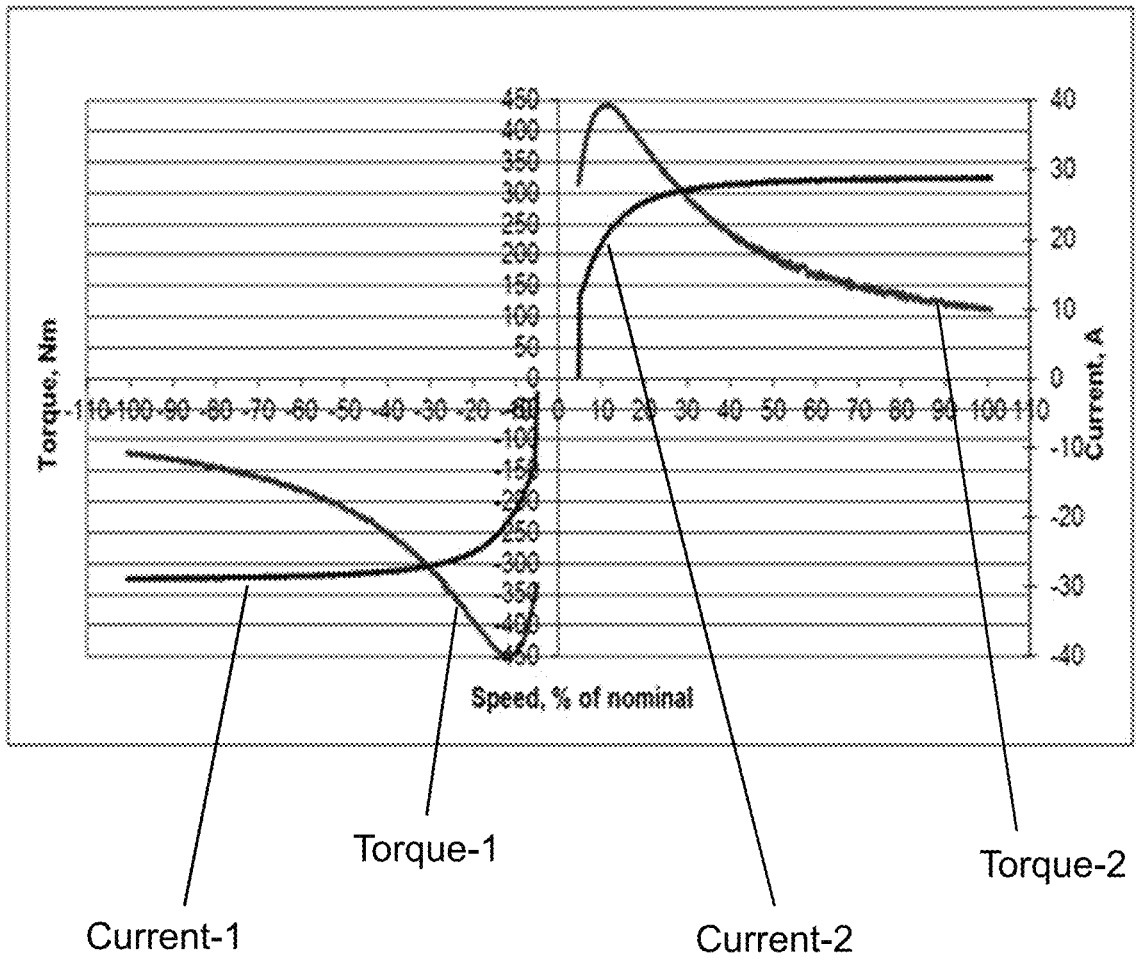
FIG. 4 shows a diagram illustrating an example for a short circuit torque and current in speed scale according to an embodiment of the present invention.

FIG. 4 shows an example for the short circuit torque and the current in speed scale. The speed is indicated as a percentage of the nominal speed, whereas the current and the torque are indicated as actual values.

As can be seen from FIG. 4, the absolute value of the current increases with an increasing speed, so that the current can be used as an indicator for the speed of the motor.

By selecting trigger current in this example as 17A, the motor will not reach its maximum short circuit torque of 450 Nm, and the elevator car will be in control and travel with low speed when the brakes are open. It is noted that due to winding construction in this example motor, the short circuit torque decreases rapidly after the peak value, thus in high unbalance cases elevator can be seen accelerating like in free fall.

As a further embodiment, instead of the current, the voltage of the motor as generated during the movement of the elevator car 10 is used as the electrical operation parameter. Namely, similar as the current, also the voltage has a unique relationship with the speed of the motor, so that also the voltage can be used as an indicator of the speed.

According to this embodiment, the detector 60 is configured to detect or to measure the voltage between the phases of the motor 36. Alternatively, also an intermediate circuit voltage (DC link voltage) of the inverter can be detected.

As a further alternative embodiment, both the current and the voltage can be used as the electrical operational parameter, for example in order to enhance the reliability of the detection. Namely, when the current and the voltage are separately detected, a redundancy can be provided. For example, whenever the current or the voltage exceeds its corresponding threshold, the brake is applied. This can enhance safety for the case that one of the current detector and the voltage detector fails.

Hence, according to the embodiments described above, the speed of the motor, and thus of the elevator car can be limited to a safe speed by detecting an electrical operational parameter and applying the brake in case the electrical operational parameter exceeds a threshold.

The solution according to the embodiments can easily be implemented, since for the motor control, usually the current and/or the voltage is detected. In this case, no additional hardware structures such as specific sensors are required.

Embodiments of the present invention are not limited to the details of the embodiments as described above, and various modifications are possible.

For example, for comparing the electrical operation amount, it is not necessary to use the actual value therefore for the comparison. Instead, a value indicating the electrical operation amount can be used. For example, the electrical operation amount can be converted into a digital value for processing, and this converted value can be compared with a suitable threshold.

Alternatively, the electrical operation amount can be converted into a percentage value. For example, the current can be converted to a percentage value which indicates a relation to a rated current of the motor, or to a maximum short circuit torque (as described above in connection with FIG. 4). When using voltage as the electrical operation amount, a percentage with respect to a rated voltage of the motor or with respect to a power supply voltage can be used.

Thus, the detected electrical operation amount according to several embodiments of the present invention also includes a converted value of the electrical operation amount and/or a percentage value as described above.

The controller 50 shown in FIG. 2 may be provided separately from a control device carrying out the overall control of the elevator, or may be part of a plurality of control units commonly carrying out the control of the elevator. Alternatively, the controller 50 may be part of a main control device carrying out the overall control of the elevator.

According to some embodiments as described above, an elevator system is described by which an elevator car is moved by means of elevator ropes and a counterweight. However, embodiments of the present invention are also applicable to other kinds of elevator systems or lifts having e.g. driving units of different types, such as rack and pinion elevator systems, traction elevator systems, by which an elevator car is driven by means of a driving unit which outputs an electrical operation amount when the elevator car is moved, and which can be braked by a brake device.

The brake device 35 described above may comprise a brake (machinery brake) and a corresponding brake controller. Thus, in this case, in the present description, applying or releasing the brake device refers to instructing the brake controller to release (or open) the brake or to apply the brake. The brake may comprise a brake frame provided at the hoisting machine (driven by the motor 36) and a brake shoe. The brake is opened by supplying current to an electromagnet in the brake frame which pulls the brake shoe off a braking surface (which may be provided on the rotor of the motor 36 or on a driving shaft connected to the rotor of the motor 36 or on another suitable moving part). Between the brake frame and the brake shoes, springs are provided by which the brake shoe is urged against the braking surface when no current is supplied to the electromagnet. However, embodiments of the present invention are not limited to this particular structure of the brake, and other suitable structures are possible.

It is to be understood that any of the above modifications can be applied singly or in combination to the respective aspects and/or embodiments to which they refer, unless they are explicitly stated as excluding alternatives.

Furthermore, elevator system elements, in particular operation elements, control elements (e.g., the controller 50) or detection elements, as well as corresponding functions as described herein, and other elements, functions or applications may be implemented by software, e.g. by a computer program product for a computer, and/or by hardware. For executing their respective functions, correspondingly used devices, elements or functions may include several means, modules, units, components, etc. (not shown) which are required for control, processing and/or communication/signaling functionality. Such means, modules, units and components may include, for example, one or more processors or processor units including one or more processing portions for executing instructions and/or programs and/or for processing data, storage or memory units or means for storing instructions, programs and/or data, for serving as a work area of the processor or processing portion and the like (e.g. ROM, RAM, EEPROM, and the like), input or interface means for inputting data and instructions by software (e.g. floppy disc, CD-ROM, EEPROM, and the like), a user interface for providing monitor and manipulation possibilities to a user (e.g. a screen, a keyboard and the like), other interface or means for establishing links and/or connections under the control of the processor unit or portion (e.g. wired and wireless interface means etc.) and the like. It is to be noted that in the present specification processing portions should not be only considered to represent physical portions of one or more processors, but may also be considered as a logical division of the referred processing tasks performed by one or more processors.

For the purpose of the present invention as described herein above, it should be noted that embodiments suitable to be implemented as software code or portions of it and being run using a processor or processing function are software code independent and can be specified using any known or future developed programming language, such as a high-level programming language, such as objective-C, C, C++, C#, Java, Python, Javascript, other scripting languages etc., or a low-level programming language, such as a machine language, or an assembler.

implementation of embodiments is hardware independent and may be implemented using any known or future developed hardware technology or any hybrids of these, such as a microprocessor or CPU (Central Processing Unit), MOS (Metal Oxide Semiconductor), CMOS (Complementary MOS), BiMOS (Bipolar MOS), BiCMOS (Bipolar CMOS), ECL (Emitter Coupled Logic), and/or TTL (Transistor-Transistor Logic).

embodiments may be implemented as individual devices, apparatuses, units, means or functions, or in a distributed fashion, for example, one or more processors or processing functions may be used or shared in the processing, or one or more processing sections or processing portions may be used and shared in the processing, wherein one physical processor or more than one physical processor may be used for implementing one or more processing portions dedicated to specific processing as described, a device may be implemented by a semiconductor chip, a chipset, or a (hardware) module including such chip or chipset;

embodiments may also be implemented as any combination of hardware and software, such as ASIC (Application Specific IC (Integrated Circuit)) components, FPGA (Field-programmable Gate Arrays) or CPLD (Complex Programmable Logic Device) components or DSP (Digital Signal Processor) components.

embodiments may also be implemented as computer program products, including a computer usable medium having a computer readable program code embodied therein, the computer readable program code adapted to execute a process as described in embodiments, wherein the computer usable medium may be a non-transitory medium.

Although the present invention has been described herein before with reference to particular embodiments thereof, the present invention is not limited thereto and various modifications can be made thereto.

The invention claimed is:

1. An elevator drive apparatus comprising:

a drive unit for driving an elevator car, the drive unit including a motor;

a brake device for braking a motion of the elevator car;

a detector for detecting an electrical operation amount of the drive unit; and a controller, wherein the controller is configured:

to release the brake device;

to compare the detected electrical operation amount with a threshold; and to apply the brake device when the detected electrical operation amount exceeds the threshold, and wherein the electrical operation amount is a current and/or a voltage generated by the motor due to a movement of the elevator car after releasing the brake device.

2. An elevator system including:

at least one elevator car carrying an elevator cabin; and the elevator drive apparatus according to claim 1.

3. An elevator drive apparatus comprising:

a drive unit for driving an elevator car;

a brake device for braking a motion of the elevator car;

a detector for detecting an electrical operation amount of the drive unit; and a controller, wherein the controller is configured:

to release the brake device;

to compare the detected electrical operation amount with a threshold; and to apply the brake device when the detected electrical operation amount exceeds the threshold, wherein the drive unit comprises a rotating electrical machine, and wherein the drive unit comprises means for short-circuiting the rotating electrical machine, and the electrical operation amount is a current generated by the rotating electrical machine due to a movement of the elevator car after releasing the brake device.

4. An elevator system including:

at least one elevator car carrying an elevator cabin; and the elevator drive apparatus according to claim 3.

5. A method for driving an elevator, comprising the steps of:

releasing a brake device configured to brake a motion of an elevator car;

detecting an electrical operation amount of a drive unit configured to drive the elevator car, the drive unit including a motor;

comparing the detected electrical operation amount with a threshold; and applying the brake device when the detected electrical operation amount exceeds the threshold, wherein the electrical operation amount is a current and/or a voltage generated by the motor due to a movement of the elevator car after releasing the brake device.

6. A computer program product embodied on a non-transitory computer readable medium and comprising code means for performing the method according to claim 5 when run on a processing means or module.

7. The computer program product according to claim 6, wherein the computer program product is directly loadable into the internal memory of the computer and/or transmittable via a network by means of at least one of upload, download and push procedures.

8. A method for driving an elevator, comprising the steps of:

releasing a brake device configured to brake a motion of an elevator car;

detecting an electrical operation amount of a drive unit configured to drive the elevator car; wherein the drive unit comprises a rotating electrical machine, comparing the detected electrical operation amount with a threshold;

applying the brake device when the detected electrical operation amount exceeds the threshold; and short-circuiting the rotating electrical machine, wherein the electrical operation amount is a current generated by the rotating electrical machine due to a movement of the elevator car after releasing the brake device.

9. A computer program product embodied on a non-transitory computer readable medium and comprising code means for performing a method according to claim 8 when run on a processing means or module.

* * * * *